US006557285B2

(12) United States Patent
Walsh, Jr.

(10) Patent No.: US 6,557,285 B2
(45) Date of Patent: May 6, 2003

(54) HANGING SIGN AND SUPPORT

(75) Inventor: John T. Walsh, Jr., Barrington, IL (US)

(73) Assignee: Sears, Roebuck & Company, Hoffman Estates, IL (US)

( * ) Notice: Subject to any disclaimer, the term of this patent is extended or adjusted under 35 U.S.C. 154(b) by 173 days.

(21) Appl. No.: 09/750,529

(22) Filed: Dec. 28, 2000

(65) Prior Publication Data

US 2002/0083631 A1 Jul. 4, 2002

(51) Int. Cl.[7] ..... G09F 7/20

(52) U.S. Cl. ..... 40/617; 40/601; 40/757; 248/328

(58) Field of Search ..... 40/617, 601, 757; 248/327, 328, 317

(56) References Cited

U.S. PATENT DOCUMENTS

| | | | | | |
|---|---|---|---|---|---|
| 1,706,606 | A | * | 3/1929 | Harkness | 248/300 |
| 2,762,598 | A | * | 9/1956 | Runge | 248/327 |
| 3,512,743 | A | * | 5/1970 | Lipscomb | 248/324 |
| 4,187,996 | A | | 2/1980 | Ehrlich | |
| 4,411,084 | A | | 10/1983 | Kraus | |
| 4,434,570 | A | | 3/1984 | Roos | |
| 5,090,145 | A | * | 2/1992 | Chiang et al. | 40/617 |
| 5,124,685 | A | | 6/1992 | Rankin | |
| 5,355,604 | A | * | 10/1994 | Rathke | 40/601 |
| 5,381,991 | A | * | 1/1995 | Stocker | 40/617 |
| 5,423,142 | A | | 6/1995 | Douglas et al. | |
| 5,471,774 | A | * | 12/1995 | Hoyt et al. | 40/601 |
| 5,529,274 | A | | 6/1996 | Anderson et al. | |
| 5,556,195 | A | | 9/1996 | Glebe | |
| 5,870,845 | A | | 2/1999 | Ruderman et al. | |
| 6,039,496 | A | | 3/2000 | Bishop | |
| 6,055,754 | A | | 5/2000 | Melhuus | |
| 6,327,803 | B1 | * | 12/2001 | Ruderman | 40/601 |

FOREIGN PATENT DOCUMENTS

| | | | | |
|---|---|---|---|---|
| GB | 2231948 | A | * 11/1990 | 248/327 |

* cited by examiner

*Primary Examiner*—D. Glenn Dayoan
*Assistant Examiner*—Greg Blankenship
(74) *Attorney, Agent, or Firm*—Michael Best & Friedrich LLP

(57) ABSTRACT

A hanging sign support has at least one housing supported by a mounting surface. The housing has an interior portion and a cord opening into the interior portion. A recoil mechanism is arranged to cooperate with the interior portion of each of the housings. A cord is associated with each recoil mechanism and has a distal end that is extendible through the cord opening and away from the respective housing. The distal end is retractable and biased by the recoil mechanism toward the interior of the respective housing. A connecting device is carried on the distal end of each cord for removably coupling the cord to a portion of a sign. Each cord, the distal end of each cord, and each connecting device can be constructed to retract into a portion of the respective housing when not supporting a sign. A spacer can be received over each cord and coupled between the respective housing and a sign supported by the cord to place the sign at a desired distance from the respective housing or the mounting surface.

28 Claims, 2 Drawing Sheets

HANGING SIGN AND SUPPORT

FIELD OF THE INVENTION

The present invention relates generally to suspended display signs, and more particularly to a hanging sign and support wherein the support can suspend a sign at a selected height and can retract out of the way when not supporting a sign.

BACKGROUND OF THE INVENTION

Signs are utilized virtually everywhere to display information useful in a particular environment. In one example, signs are utilized in stores and shopping centers to display information such as product location within a store, sale price information, product price and technical information and the like. Signs such as retail store signs are often needed only periodically and are taken down when not needed. Also, the location of many signs within a store environment will change as product displays are moved, altered or changed over for a new product.

Signs that are suspended from a mounting surface such as a wall or a ceiling typically require permanent bracketry to support the sign or require significant labor to install such bracketry when necessary. When not in use, the bracketry either remains intact and visible or is manually removed and dismantled. Sometimes these signs are mounted on ceilings that are quite high and that require specialized personnel and/or equipment in order remove the sign or dismantle the bracketry. If the sign is simply removed and the bracketry left visible, the aesthetic appearance within the store may be negatively affected.

There is therefore a need for a hanging sign and support wherein the support can suspend a sign from a wall or ceiling and, when not supporting a sign, will simply retract and "disappear" or blend in with the surrounding environment.

SUMMARY OF THE INVENTION

Objects, features and advantages of the present invention will become apparent upon a review of the detailed description of the examples of the invention and the accompanying drawing figures. In accordance with the invention, a hanging sign support has at least one housing supported by a mounting surface. Each housing has an interior portion and a cord opening into the interior portion. A corresponding recoil mechanism cooperates with the interior portion of each housing. Each recoil mechanism has a cord with a distal end that is extendable through the cord opening and away from the corresponding housing. The distal end of the cord is retractably biased by the recoil mechanism toward the interior of the housing. A connecting device is carried on the distal end of each cord for removably coupling the cord to a portion of a sign. Each cord, the distal end of each cord, and each connecting device are retracted into a portion of the corresponding housing when not supporting a sign.

In one embodiment, the hanging sign support also has a sign removably coupled to each connecting device and supported by each cord.

As for other features of the invention, the hanging sign support may be mounted to a ceiling surface, or alternatively, it may be mounted to a wall surface. Also, each recoil mechanism may be mounted behind the mounting surface so that only a portion of the cord passes through the interior portion and cord opening of the housing. In an alternative embodiment, each recoil mechanism may be housed within the interior portion of the corresponding housing.

In other respects, a recess may surround the cord opening in each of the housings and be of a size and contour sufficient to receive the connecting device and distal end of the corresponding cord completely within the recess when the cord is retracted into the respective housing. The housing may also be dome shaped. In an alternative embodiment, the housing may be designed to have an aesthetic exterior shape that coordinates with a decor of a surrounding environment.

In still another respect, the connecting device of each cord may be adapted to connect with a corresponding fitting carried on a top structure of a sign.

In further accord with the invention, a hanging sign and support has at least one housing mounted to a surface. Each housing has an interior portion and a cord opening into the interior portion. A corresponding recoil mechanism cooperates with the interior portion of each housing. A cord is associated with each recoil mechanism wherein each cord has a distal end that is extendable through the cord opening and away from the corresponding housing. The distal end of the cord is retractably biased by the recoil mechanism toward the interior portion of the housing. A connecting device is carried on the distal end of each cord and a sign is coupled to each connecting device and supported by each cord. A spacer is removably received over each cord between the corresponding housing and the sign. Each spacer has a length that defines a distance between the corresponding housing and the sign to position the sign as desired.

In one embodiment, each spacer may be selected from a plurality of the spacers of various length.

As for still other features of the invention, each spacer may be an elongate tube having a diameter that is large enough to pass the connecting device and the distal end of the respective cord through the tube when installing the tube on the respective cord. In an alternative example, each spacer is an elongate tube having a slit extending the length of the tube for installing the spacer on the corresponding cord by passing the cord through the slit.

In other respects, each spacer may have a first end that bears against the corresponding housing near the cord opening, and the first end of the spacer may be contoured to match a housing contour where it bears against the housing. Further, each spacer may have a second end that bears against a portion of the sign, and the second end is contoured to match a contour of the portion of the sign where it bears against the sign.

In still another respect, each spacer may be molded from a plastic material.

In another embodiment, the hanging sign and support may have a plurality of the housings mounted spaced apart on a surface. A plurality of the recoil mechanisms may then be provided, each cooperating with a corresponding one of the plurality of housings and each having a separate retractable cord. In this embodiment, a plurality of fittings may be carried so as to be spaced apart along a top structure of the sign such that each fitting may be removably attached to the connecting device of a corresponding one of the cords.

In still further accord with the invention, a hanging sign and support has at least one housing mounted to a surface. Each housing has an interior portion and a cord opening into the interior portion. A corresponding recoil mechanism cooperates with the interior portion of each housing. A cord is associated with each recoil mechanism wherein each cord has a distal end that is extendable through the cord opening and away from the corresponding housing. Each distal end is retractably biased by the recoil mechanism toward the interior portion of the corresponding housing. A connecting device is carried on the distal end of each cord and, each cord, the distal end of each cord, and each connecting device are retractable completely into a recess of the corresponding housing when not supporting a sign. A sign is coupled to each connecting device and supported by each cord. A spacer is removably received over each cord between the corresponding housing and the sign. Each spacer has a length that defines a distance between the corresponding housing and the sign.

Other objects, features and advantages of the present invention are inherent in the hanging sign and support as claimed and disclosed herein. These and other objects, features and advantages will become apparent to those skilled in the art from the following detailed description read in conjunction with the accompanying drawings.

DESCRIPTION OF THE PREFERRED EMBODIMENTS

Figure 2:
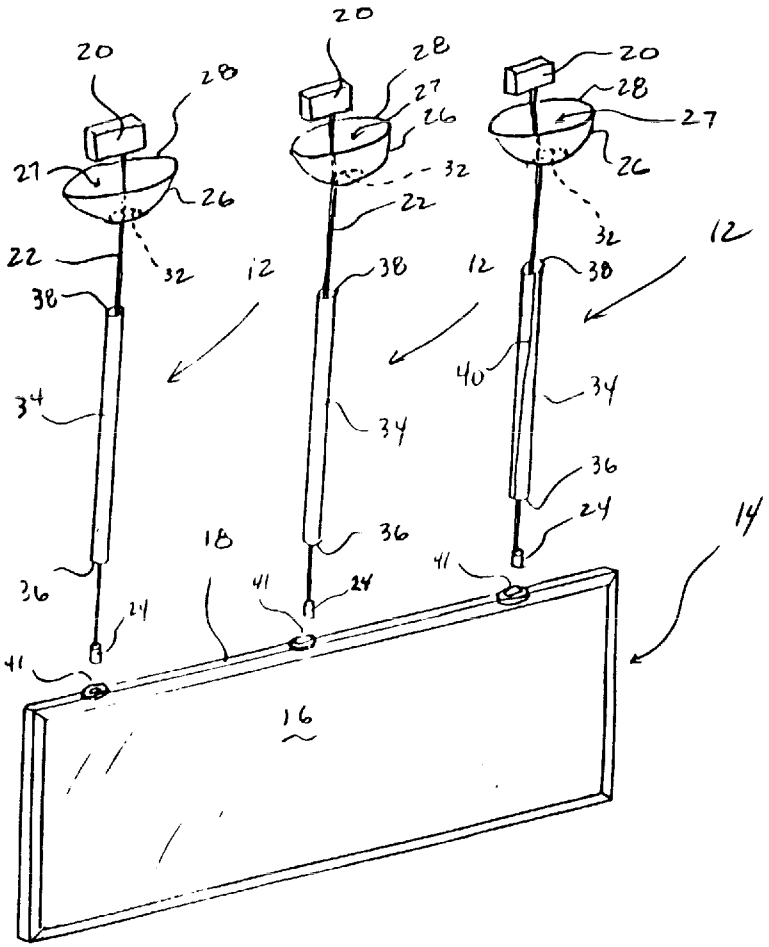
FIG. 2 is a partially exploded perspective view of another example of a hanging sign and support constructed according to the teachings of the present invention.
Figure 1:
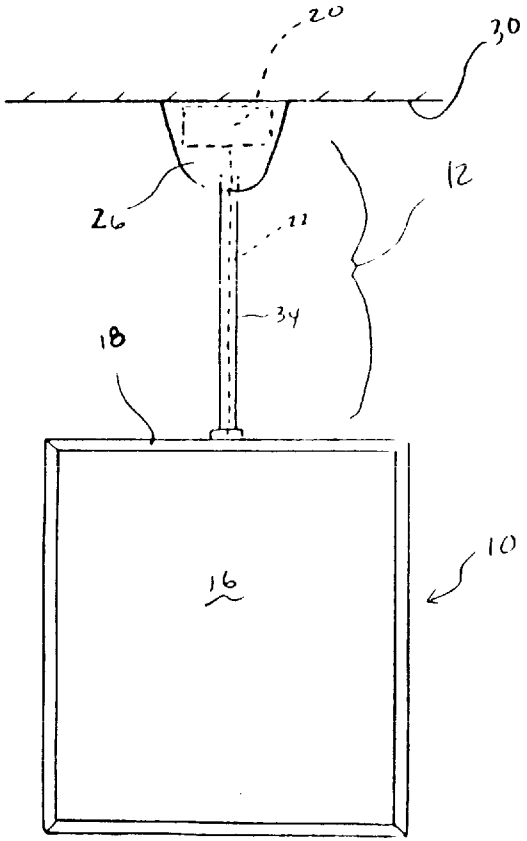
FIG. 1 is a front view of one example of a hanging sign and support constructed according to the teachings of the present invention.

Referring now to the drawings, FIG. 1 is a front view of one example of a hanging sign 10 suspended by a support 12 constructed according to the teachings of the present invention. FIG. 1 illustrates the hanging sign 10 in a suspended condition. FIG. 2 illustrates another alternative example of a hanging sign 14 supported by a plurality of the supports 12. In each example, the signs 10 and 14 include a region or surface 16 for displaying information that varies depending upon the intended location and use of the signs. Either one side or both sides of the region 16 can be utilized to display information as necessary.

Though the construction of the signs 10 and 14 can vary considerably without departing from the spirit and scope of the invention, each of the signs as shown has a top structure 18 that is adapted to connect to one or more of the supports 12. In the present examples, the top structure 18 comprises one portion of a geometric frame structure surrounding the display region 16 of the respective sign. Other types of hanging sign top structures can be utilized as long as they are adapted to support a hanging sign display region 16 and are further adapted to removably couple to one or more of the supports 12.

As shown in FIGS. 1 and 2, each support 12 generally has a recoil mechanism 20, herein identified as a pullbox, and a retractable cord 22 that can be extended from the pullbox. Pullboxes are known and some types are adapted to provide a constant tension on the cord 22 when the cord is extended from the pullbox. One example of such a pullbox is available from Vulcan Spring and Mfg. Co. and is known as a SUPER PULLBOX®. The Vulcan SUPER PULLBOX® is available in different forms but can be provided with a maximum cable length of ten feet or more and a maximum cord tension or pull force of six pounds or more.

In one example, the pullbox 20 is provided with a connecting device 24 on the distal end of the cord 22 as illustrated in FIG. 2. As will be evident to those of ordinary skill in the art, other such retractable cord recoil mechanisms are available and can be utilized according to the teachings of the present invention. Some of these devices include constant tension cords and others include detent stops at cord retraction intervals. In addition, the connecting device 24 on the end of the cord 22 can also vary considerably within the scope of the invention.

In the example of FIGS. 1 and 2, each of the supports 12 is provided with a corresponding cover or housing 26 for visually enhancing the appearance of the support 12. In the present example, each housing 26 has a cavity or interior portion 27 for receiving the pullbox therein and further has an attaching surface 28 adapted to abut against a mounting surface such as a ceiling 30. The attaching surface 28 can be adapted to conform to the configuration or contour of the mounting surface where mounted. The housing 26 can be adapted to mount or attach to the surface 30 and further can be adapted to mount the pullbox 20 directly to the housing. Alternatively, the pullbox 20 can be adapted to mount directly to the surface 30 and the housing 26 can be adapted to attach either directly to the pullbox or directly to the surface 30 though separate from the pullbox.

In the illustrated example, the housing 26 includes a lower cord opening 32 through which the cord 22 extends. As described in more detail below, the cord opening 32 can vary in configuration and construction in order to hide part or all of the cord 22 and the associated connecting device 24.

Each support 12 in the illustrated example has an elongate spacer 34 in the form of a tube removably received over the cord 22. Each spacer 34 has a lower end 36 and an upper end 38. The lower end 36 bears against a portion of the hanging sign 12 or 14 suspended from the cord 22. The upper end 38 bears against a portion of the housing 26 or directly against the mounting surface 30. Each spacer 34 has a predetermined length between it's lower and upper ends for suspending a hanging sign at a prescribed distance from the mounting surface 30 as illustrated in FIG. 1. The spacer 34 can be formed in shapes other than a tube, as long as the spacer can hold a sign at a fixed distance from the mounting surface until the spacer is physically removed.

A plurality of the spacers 34 can be provided having different lengths. A user can select one or more of the spacers 34 of a particular length to support a hanging sign at a desired height.

In order to install the tube spacer 34 over the cord 22, the tube can have a diameter that is large enough to be received over the connecting device 24. However, in such an example, the tube 34 must be supported by hand until the hanging sign is attached to the connecting device 24 so that the tube does not slide off the end of the cord 22. In an alternative example, the tube 34 can be provided having a diameter that is smaller than the connecting device 24 so that the tube does not slide off the end of the cord 22. Each tube can be formed from a somewhat resilient or flexible material such as molded plastic and have an elongate slit 40 provided along the entire length of the tube from the lower end 36 to the upper end 38. Such a slit 40 is illustrated on the right-most one of the tubes 34 shown in FIG. 2. The cord 22 can be received through the slit 40 as the tube is spread apart at the slit.

To utilize the supports 12 as described above, each cord is pulled down from the pullbox 20 and the housing 26. The appropriate length spacer 34 is installed on each cord. The number of cords and spacers depends upon how many supports 12 are used to hang a sign. Each connecting device 24 is then attached to the top structure 18 of the hanging sign 10 or 14. Each cord 22 will retract back toward the pullbox 20 only until the upper end 38 and the lower end 36 of each spacer 34 abut against their appropriate surfaces. The pre-selected length of the spacers then retains the hanging sign at the desired position relative to the mounting surface 30. To remove the hanging sign 10 or 14, each of the connecting devices 24 is detached from the top structure 18, the one or more spacers 34 are removed, and the one or more cords 22 are released. The cords will then fully retract back into the corresponding pullbox. The cord, mounting surface, and/or housing components can each formed such that the cord retracts until the connecting device bears against a desired portion of one of the components, instead of retracting completely into the pullbox. As shown in FIGS. 1 and 2, some signs will require only one support 12 while other signs may require two or more of the supports.

FIG. 2 illustrates one example of a plurality of supports 12 each having a connecting device 24 carried on the cord 22. A plurality of corresponding fittings 41 are carried on the top structure 18 of the sign 14. Each fitting 41 is adapted for coupling to one of the connecting devices 24.

Figure 3:
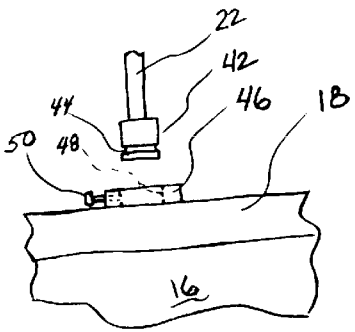
FIG. 3 is a front view of the connecting device of the support shown in FIG. 1 and is separated from the sign.

FIG. 3 illustrates one particular example of a fitting or connecting device 24 attached to distal end of the cord 22 and a corresponding fitting 41 for coupling to the top structure 18 of a hanging sign. The connecting device is a fitting or slug 42 secured to the distal end of the cord 22. In this example, the slug 42 has a perimeter groove 44 formed near its lower end. The slug 42 is received in a fitting in the form of a circular coupling 46 carried on the top structure 18 of the hanging sign. The coupling 46 has an opening 48 for receiving a portion of the slug 42 therein. In the present example, a set screw 50 is threaded into and out of interference with the opening 48 and is received in the groove 44 to lock the slug 42 in place to connect and release the hanging sign relative to the support 12. As will be evident to those of ordinary skill in the art, many other connecting devices 24 and fittings 41 can be utilized for coupling the hanging sign to the one or more supports 12 of the invention. However, the slug 42 and coupling 46 are the only particular examples of a connecting device and fitting illustrated herein.

Figure 4:
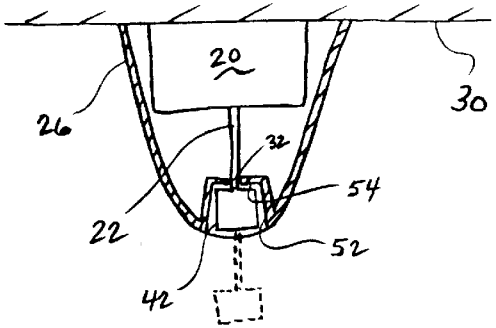
FIG. 4 is a partial cross section of a portion of the support shown in FIG. 1 wherein the hanging sign has been removed.

FIG. 4 illustrates one example of a housing structure for completely hiding the cord 22 and the connecting device 24 when not supporting a hanging sign. FIG. 4 shows a cross section through the housing 26 and shows the pullbox 20 secured to the mounting surface or ceiling 30. The housing 26 is removably attached to the ceiling 30. The housing has a recess 52 at its lower end surrounding the cord opening 32. The recess is deep enough and has a diameter sufficient to fully receive the connecting device such as the slug 42 therein when the cord is retracted into the pullbox 20. In this example, the slug 42 bears against a bottom surface 54 of the recess 52 when retracted. The slug 42 is fully received in the recess 52 and is essentially not visible. When needed to support a sign, the slug 42 and cord 22 are pulled from the recess as illustrated in phantom view in FIG. 4.

Figure 5:
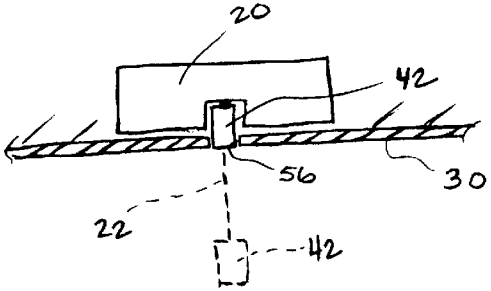
FIG. 5 is a partial cross section of an alternative mounting arrangement for a hanging sign support constructed according to the teachings of the present invention.

FIG. 5 shows an alternative construction of a support 12 wherein no housing 26 is needed. Instead, the pullbox 20 is mounted above and essentially hidden by the mounting surface 30 such as a ceiling. In this example, the connecting device or slug 42 is received completely into an opening 56 in the ceiling when not supporting a hanging sign. In this manner, the support 20 is essentially invisible or undetectable unless the cord 22 and connecting device or slug 42 are retracted from the pullbox 20 for supporting a sign.

As will be evident to those of ordinary skill in the art, it is not necessary to hide the connecting device within a housing or position the connecting device flush with or behind a mounting surface 30 when the support 12 is not in use. Instead, the connecting device can be visible and yet perform its intended function. Further, the housing 26 and the connecting devices 24 can provided with appropriate decorative colors, shapes and contours to coordinate with the surrounding environment as desired.

Figure 6:
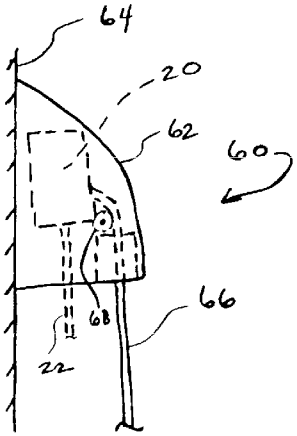
FIG. 6 is another example of a hanging sign support constructed according to the teachings of the present invention.

FIG. 6 illustrates another alternative example of a support 60 constructed according to the teachings of the present invention. In this example, a decorative housing 62 is mounted to a vertical wall mounting surface 64 instead of a horizontal ceiling surface as in the prior examples. In FIG. 6, the pullbox 20 is received within the decorative wall housing 62 and is either mounted to the decorative housing or to the wall surface. Two alternative cord configurations are illustrated in FIG. 6. In one example, the cord 22 is suspended directly beneath the pullbox 20 and is adapted to support a hanging sign as described in the prior examples. In an alternative example, a cord 66 can be suspended forward from the pullbox 20 at a desired distance positioning the cord 66 away from the wall mounting surface 64. In this example, the hanging sign support can be used to hang a display sign adjacent a wall surface as desired. In the example of the forwardly suspended cord 66, the cord is cantilevered or suspended on a roller, pulley 68, or the like. Alternatively, the forwardly suspended cord 66 can be supported on a sliding cantilevered surface that is either fixed to the pullbox 20 or to the decorative housing 62, or is adjustably connected to either the pullbox or the housing for selectively positioning the cord 66 relative to the wall surface 64.

The foregoing detailed description has been given for clearness of understanding only. No unnecessary limitations should be understand from the examples provided herein, as modifications would be obvious to those of ordinary skill in the art.

What is claimed is:

1. A hanging sign support comprising:

at least one housing supported by a mounting surface and having an interior portion and a cord opening into the interior portion;

a recoil mechanism cooperating with the interior portion of each housing, each recoil mechanism having a cord with a distal end that is extendible through the cord opening and away from the corresponding housing, wherein the distal end is retractable biased by the recoil mechanism toward the interior portion of the corresponding housing; and a connecting device carried on the distal end of each cord for removably coupling each cord to a portion of a sign, wherein each cord, the distal end of each cord, and each connecting device are retracted into a portion of the corresponding housing when not supporting a sign.

2. A hanging sign support according to claim 1, further comprising:

a sign removably coupled to each connecting device and supported by each cord.

3. A hanging sign support according to claim 1, wherein each housing is mounted to a ceiling surface.

4. A hanging sign support according to claim 1, wherein each housing is mounted to a wall surface.

5. A hanging sign support according to claim 1, wherein each recoil mechanism is mounted outside of the interior portion of the housing such that only a portion of the corresponding cord passes through the interior portion and the cord opening of the corresponding housing.

6. A hanging sign support according to claim 1, wherein each recoil mechanism is housed within the interior portion of the corresponding housing.

7. A hanging sign support according to claim 1, further comprising:

a recess surrounding the cord opening of each housing, each recess having a size and contour sufficient to receive therein the connecting device when the cord is retracted into the corresponding housing.

8. A hanging sign support according to claim 1, wherein each housing is dome shaped.

9. A hanging sign support according to claim 1, wherein each connecting device is a fitting attached to the distal end of each cord, and wherein each fitting is adapted to connect with a corresponding fitting carried on a top structure of a sign.

10. A hanging sign and support comprising:

at least one recoil mechanism mounted to a surface;

a cord associated with each recoil mechanism, each cord having a distal end that is extendible from the corresponding recoil mechanism and is retractably biased by the corresponding recoil mechanism;

a connecting device carried on the distal end of each cord;

a sign coupled to each connecting device and supported by each cord; and a spacer removably received over each cord between the mounting surface and the sign, each spacer having a length defining a distance between the mounting surface and the sign.

11. A hanging sign and support according to claim 10, wherein each spacer is selected from a plurality of the spacers of various length.

12. A hanging sign and support according to claim 10, wherein each spacer is an elongate tube having a diameter that is large enough to pass the tube over the connecting device and the distal end of the corresponding cord when installing the tube on the cord.

13. A hanging sign and support according to claim 10, wherein each spacer is an elongate tube having a slit extending the length of the tube for installing the spacer on the corresponding cord by passing the cord through the slit.

14. A hanging sign and support according to claim 10, wherein each spacer is molded from a plastic material.

15. A hanging sign and support according to claim 10, further comprising:

at least one housing associated with each one recoil mechanism, each housing having an interior portion and a cord opening, and wherein each recoil mechanisms cooperates with the interior portion of the corresponding housing such that the distal end and the connecting device of the corresponding cord extend through the cord opening.

16. A hanging sign and support according to claim 15, wherein each spacer has a first end that bears against the corresponding housing near the cord opening and that is contoured to match a contour of the corresponding housing where the first end bears against the corresponding housing.

17. A hanging sign and support according to claim 15, wherein each cord, the distal end of each cord, and the connecting device of each cord are retractable into a recess of the corresponding housing when the sign is removed from each connecting device.

18. A hanging sign and support according to claim 10, wherein each spacer has a second end that bears against a portion of the sign and that is contoured to match a contour of the portion of the sign where the second end bears against the portion of the sign.

19. A hanging sign and support according to claim 10, further comprising:

a plurality of the recoil mechanisms, each having a separate retractable cord and connecting device; and a plurality of fittings carried spaced apart along a top structure of the sign, each fitting removably attached to a corresponding one of the connecting devices.

20. A hanging sign and support comprising:

at least one housing mounted to a surface and having an interior portion and a cord opening into the interior portion;

a recoil mechanism cooperating with the interior portion of each housing, each recoil mechanism having a cord with a distal end that is extendible through the cord opening and away from the corresponding housing, wherein the distal end is retractably biased by the recoil mechanism toward the interior of the corresponding housing;

a connecting device carried on the distal end of each cord, wherein each cord, the distal end of each cord, and each connecting device are retracted into a portion of the corresponding housing when not supporting a sign;

a sign coupled to each connecting device and supported by each cord; and a spacer removably received over each cord between each housing and the sign, each spacer having a length defining a distance between the corresponding housing and the sign.

21. A hanging sign support assembly, the support assembly adapted to be mounted on a mounting surface and further adapted to be removably coupled to a sign, the support assembly comprising:

at least one recoil mechanism mounted to the mounting surface;

a cord corresponding to each of the at least one recoil mechanisms, each cord having a distal end that is extendible from the corresponding recoil mechanism and is retractably biased by the corresponding recoil mechanism; and a connecting device carried on the distal end of each cord, wherein each cord, the distal end of each cord, and each connecting device are retracted toward the corresponding recoil mechanism when not supporting the sign.

22. The support assembly of claim 21, wherein a spacer is removably received over each cord between the mounting surface and the sign, each spacer having a length defining a distance between the mounting surface and the sign.

23. The support assembly of claim 22, wherein each spacer is an elongate tube having a diameter that is large enough to pass the tube over the connecting device and the distal end of the corresponding cord when installing the tube on the cord.

24. The support assembly of claim 22, wherein each spacer is an elongate tube having a slit extending the length of the tube for installing the spacer on the corresponding cord by passing the cord through the slit.

25. The support assembly of claim 21 further comprising at least one housing associated with each of the at least one recoil mechanisms, each housing having an interior portion and a cord opening, and wherein each of the at least one recoil mechanisms cooperates with the interior portion of the corresponding housing such that the distal end and the connecting device of the corresponding cord extend through the cord opening.

26. The support assembly of claim 25, wherein each cord, the distal end of each cord, and the connecting device of each cord are retractable into a recess of the corresponding housing when the sign is removed from each connecting device.

27. The support of claim 25, wherein each recoil mechanism is housed within the interior portion of the corresponding housing.

28. The support assembly of claim 21, further comprising a plurality of recoil mechanisms, each having a separate retractable cord and connecting device, and wherein each connecting device is removably attached to a plurality of corresponding fittings spaced apart along a top structure of the sign.

* * * * *